United States Patent [19]

Frain

[11] Patent Number: 4,774,887

[45] Date of Patent: Oct. 4, 1988

[54] UNDERWATER POWERHEAD

[76] Inventor: Denise A. Frain, 628 SE. 5th St., Delray Beach, Fla. 33483

[21] Appl. No.: 75,652

[22] Filed: Jul. 20, 1987

[51] Int. Cl.[4] ..... F41B 13/00

[52] U.S. Cl. ..... 42/1.14; 43/6

[58] Field of Search ..... 42/1.14; 102/371; 43/6

[56] References Cited

U.S. PATENT DOCUMENTS

| | | | |
|---|---|---|---|
| 3,274,936 | 9/1966 | Messina et al. | 42/1.14 |
| 3,580,172 | 5/1971 | Hendricks | 43/6 |
| 3,747,247 | 7/1973 | McNair | 42/1.14 |
| 3,871,120 | 3/1975 | Mounier | 42/1.14 |
| 3,878,788 | 4/1975 | Ah Sam | 42/1.14 |
| 4,100,692 | 7/1978 | Cameron et al. | 42/1.14 |

FOREIGN PATENT DOCUMENTS

| | | | |
|---|---|---|---|
| 166015 | 4/1954 | Australia | 42/1.14 |
| 2035833 | 1/1972 | Fed. Rep. of Germany | 42/1.14 |

*Primary Examiner*—Deborah L. Kyle
*Assistant Examiner*—Michael J. Carone

[57] ABSTRACT

An underwater powerhead which consists of an outer barrel which houses an explosive cartridge. This powerhead slips over a pointed spear tip and is ready to use immediately. The point of the spear tip acts as a firing pin to activate or "fire" the cartridge. Upon impact with the fish, the cartridge explodes, enters the fish, and kills it.

1 Claim, 1 Drawing Sheet

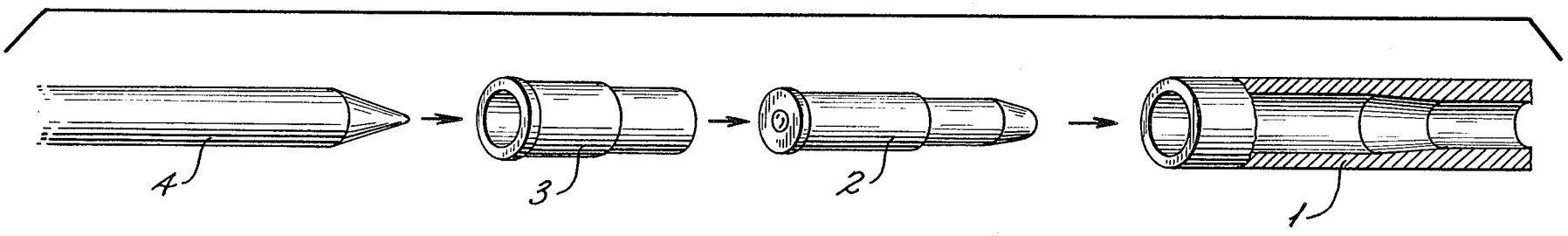
4
3
2
1

UNDERWATER POWERHEAD

This invention relates generally to a firearm device, and more specifically to a firearm device for use underwater to kill fish.

Powerheads are used to kill fish. The problem with the powerheads in use today is that they have the potential to fire unintentially. This invention eliminates this problem.

This improved powerhead guards against accidental misfires. Previous powerheads have an internal firing pin that strikes the explosive cartridge and causes it to fire. If the powerhead is accidently dropped, it could fire prematurely. This improved powerhead doesn't have a firing pin. The pointed tip of the spear it rides on acts as a firing pin. The spear has to be propelled against the powerhead to cause it to fire.

Another objective of this invention is speed and ease of use. Previous powerheads usually screw onto the spear or consist of two parts that have to be put together. This makes them time consuming. This improved powerhead slips onto the spear and is ready to use immediately.

FIG. 1 is a side elevational view of the powerhead.

Referring more particularily to drawing 1, there is shown a side view of the powerhead with the outer barrel (1) internally contoured to receive the explosive cartridge (2). The contouring provides positive resistance to channel the bullet tip of the cartridge (2) out of the barrel (1) with maximum force. Butting up against the rear of the explosive cartridge (2) is the sleeve means (3). The sleeve means (3) provides the means for the spear (4) to align up and make contact with the explosive cartridge (2).

It should be noted that since this invention is to be used underwater, that all parts should be made of materials that are resistant to the corrosive action of the sea. Materials could also be plated with corrosion resistant material.

It is thought that the advantages of this invention will be understood from the forgoing description. Numerous changes may be made which will readily suggest themselves to those skilled in the art and are encompassed in the spirit of this invention as disclosed and as defined in these claims.

I claim:

1. A powerhead in combination with a spear, said powerhead comprising:

(a) a tubular barrel defining a cartridge receiving end and an explosive discharge end;

(b) an explosive cartridge positioned in said cartridge receiving end;

(c) a tubular sleeve having one end positioned within said barrel between said explosive cartridge and said cartridge receiving end thereby preventing movement of said explosive cartridge toward said cartridge receiving end, and having a second end projecting from said cartridge receiving end; and (d) a spear tip attached to said spear positioned within said second end; whereby when said powerhead is thrusted towards and contacts a target said spear tip travels through said tubular sleeve to said one end and contacts and explodes said explosive cartridge.

* * * * *